United States Patent [19]

Llort

[11] Patent Number: 4,832,385

[45] Date of Patent: May 23, 1989

[54] LOCK WITH ELECTRICALLY CONTROLLED SETTING BY MEANS OF AN ELECTROMAGNET

[76] Inventor: Oscar Llort, 3, Rue Pierre Curie, F-38000 Grenoble, France

[21] Appl. No.: 96,112

[22] PCT Filed: Dec. 9, 1986

[86] PCT No.: PCT/FR86/00426

§ 371 Date: Aug. 6, 1987

§ 102(e) Date: Aug. 6, 1987

[87] PCT Pub. No.: WO87/03640

PCT Pub. Date: Jun. 18, 1987

[30] Foreign Application Priority Data

Dec. 11, 1985 [FR] France ..... 85 18356

[51] Int. Cl.[4] ..... E05C 21/00

[52] U.S. Cl. ..... 292/144; 292/347; 292/DIG. 27

[58] Field of Search ..... 292/144, 201, 336.3, 292/347, 359, DIG. 27; 70/222

[56] References Cited

U.S. PATENT DOCUMENTS 3,967,846 7/1976 Schloge ..... 292/359

4,073,527 2/1978 Schloge ..... 292/144 X

FOREIGN PATENT DOCUMENTS 2554858 5/1985 France .

*Primary Examiner*—Richard E. Moore

*Attorney, Agent, or Firm*—Marshall, O'Toole, Gerstein, Murray & Bicknell

[57] ABSTRACT

Lock (1) with electrically controlled setting, comprising two rotatably mounted coaxial components (32; 52, 41), of which one is connected to a locking means in order to move it and the other to an actuating means, at least one electromagnet comprising a magnet (49) and a coil (46), one of the elements of this electromagnet being rotatably mounted coaxially relative to the said component, in order to be driven in rotation from a first angular position to a second angular position when the coil receives an electrical pulse, a connecting element (55) mounted on the said first component and designed to be shifted between an active position engaged with the second component, in order to connect the said first and second components in terms of rotation, and a retracted position, and a cam (65) carried by the movable element (46) of the electromagnet and designed to act on the said connecting element (55), in order to shift it from its retracted position to its active position when the movable element (46) of the electromagnet changes from its first angular position to a second angular position.

10 Claims, 13 Drawing Sheets

FIG. 2
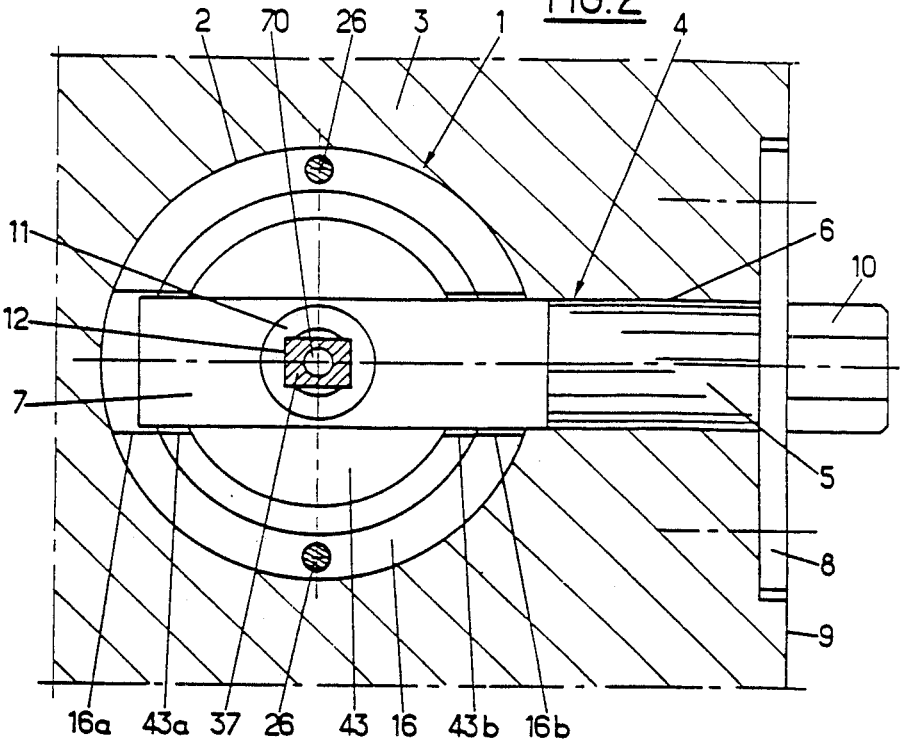
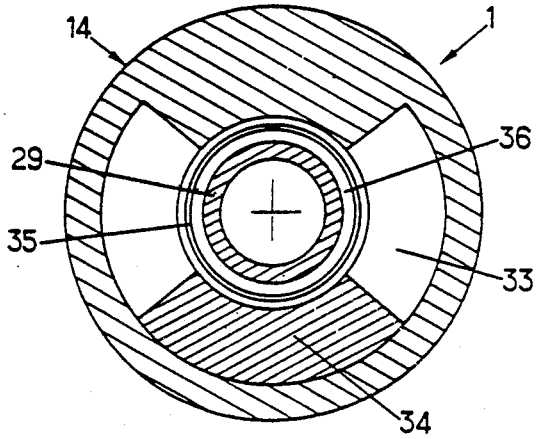
FIG. 3

LOCK WITH ELECTRICALLY CONTROLLED SETTING BY MEANS OF AN ELECTROMAGNET

The present invention relates to the field of locks.

The U.S. Pat No. 3,967,846 makes known a door lock, in which there is an annular electromagnet, of which the coil is stationary and the magnet, guided in the latter, acts on a locking finger of the spindle of the lock.

The present invention relates to a lock of a completely different type and is concerned with a lock with electrically controlled setting by means of an electromagnet.

According to the present invention, this lock with electrically controlled setting by means of an electromagnet comprises:

a first and a second coaxial component which are mounted rotatably in a lock body and of which one is connected to at least one bolt or any other locking means in order to move it and the other to a handle or any other actuating means;

at least one electromagnet comprising a magnet and a coil coupled magnetically, at least one of the elements of this electromagnet being rotatably mounted coaxially relative to the said components, in order to be driven in rotation from a first angular end position to a second angular end position when the coil receives an electrical pulse;

at least one connecting element mounted on the said first component and designed to be shifted between a first and a second end position, this connecting element, in its second position, being engaged with the second component, in order to connect the said first and second components in terms of rotation at least in one direction, whilst, in its first position, the said components are free to rotate relative to one another;

at least one cam and one cam follower, of which one is carried by the movable element of the said electromagnet and the other by the said connecting element, this cam and this cam follower being designed to interact so as to shift the said connecting element in one direction from one of its end positions to the other, when the movable element of the electromagnet changes from its first angular position to its second angular position, and at least one restoring means designed to stress the said connecting element in its other shifting direction;

in such a way that, with the said components being in corresponding angular positions and being connected in terms of rotation by means of the said connecting element, the movement of the bolt connected to one of the said components is obtained as a result of the actuation of the other component which is connected to the handle.

Preferably, according to the present invention, the said magnet is stationary and the said coil is pivotably mounted coaxially relative to the said components.

According to the present invention, the said magnet and the said coil are preferably in the form of ring segments.

According to the present invention, the said cam and the said cam follower can advantageously be designed to interact so as to shift the said connecting element from its first position to its second position, the said restoring means being a spring.

In a preferred practical alternative form, the said connecting element is formed by an arm articulated on the said first component eccentrically and radially movably, in such a way that its free end can be brought into engagement with the said second component, the said cam and the said cam follower being designed to stress the said arm radially.

Preferably, according to the present invention, elastic means stress at least one of the said components towards a position of rest, in which the said connecting element can be brought into engagement with the other component when the latter is in at least one corresponding position of rest.

In a preferred alternative embodiment, the said lock body comprises a radial plate, from which an axial sleeve projects, this radial plate carrying the stationary element of the electromagnet laterally on the same side as the said sleeve, a support, mounted rotatably on the said sleeve, carrying the movable element of the electromagnet, the said first component comprising a radial plate mounted rotatably in the said lock body and carrying an arm articulated eccentrically and radially movably, the said second component comprising an annular part provided with at least one recess, the said rotary support and the said arm possessing one the said cam and the other the said cam follower, the free end of the said arm being designed to engage with at least one of the ends of the said recess of the annular part of the said second component.

The lock according to the present invention can advantageously comprise a lock body which has a part coaxial relative to the said components and in which the said stationary radial plate is located and the said cylindrical part of the said second component is mounted rotatably, the said first component comprising a shaft extending through the said sleeve and carrying the said plate equipped with the said connecting arm, the said annular part of the said second component and the said shaft being connected one to an actuating handle and the other to a bolt.

In an alternative form according to the invention, the actuating handle and the bolt can be coaxial relative to the said components. In another alternative form, one of the said components is connected to an actuating handle, of which the spindle is eccentic relative to the axis of the said coaxial components, the other component being connected to a bolt.

According to the present invention, it may seem advantageous to provide such means of locking the bolt that, with the said components being in corresponding angular positions and the said connecting element being in its second position, the latter, in a first phase of the rotary movement of the said first component, transmits a movement to intermediate means which act on the said locking means in the direction which releases the bolt and, in a second phase, causes the bolt to move.

The present invention will be understood better from a study of several locks with electrically controlled setting by means of an electromagnet and with manual actuation, which are described by way of non-limiting examples and which are illustrated in the drawing in which:

FIG. 2 shows a radial mid-section along the line II—II through the lock of FIG. 1, in the position of rest;

FIG. 3 shows a radial section along the line III—III of the lock of FIG. 1, in the position of rest;

Figure 1:
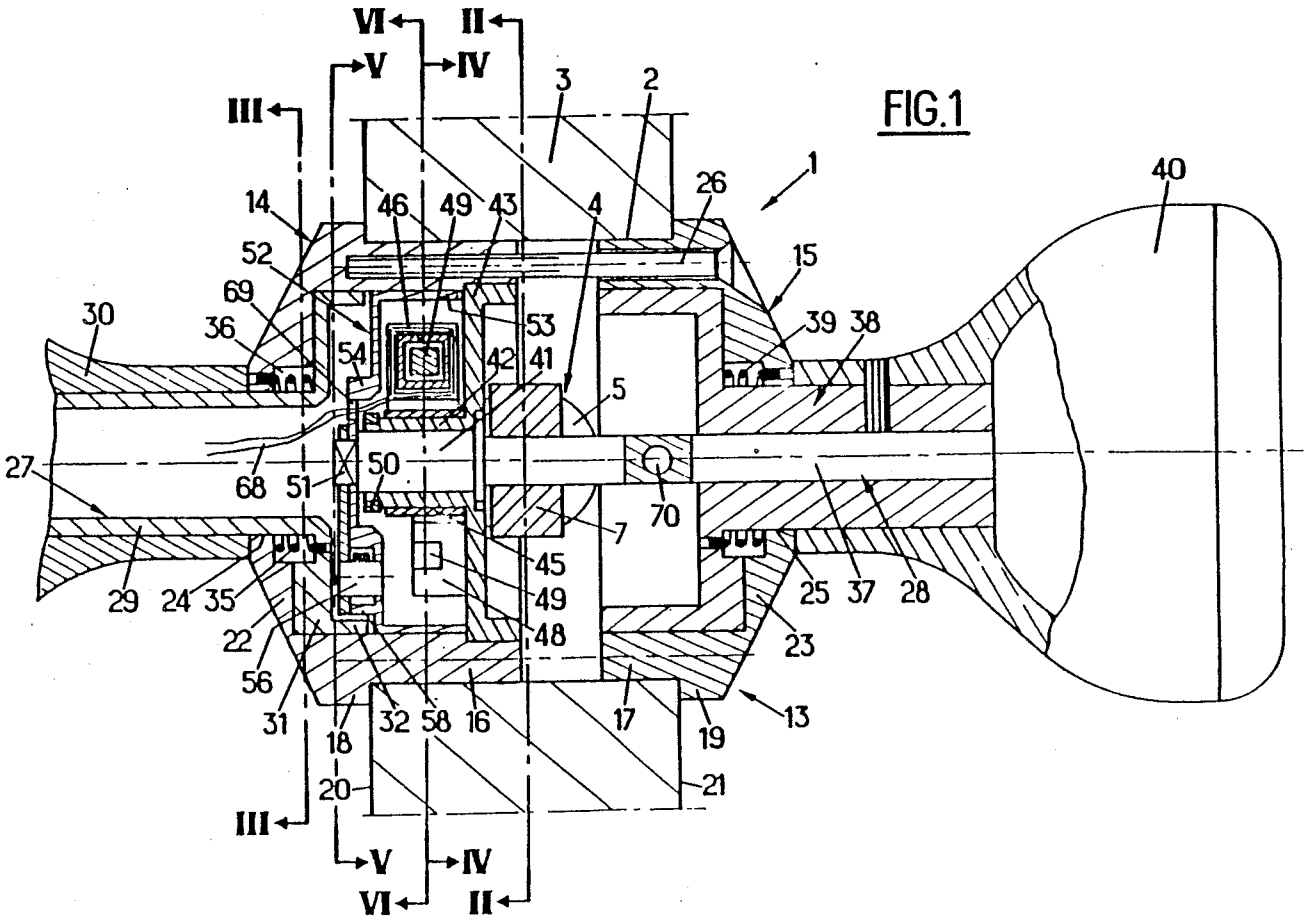
FIG. 1 shows a vertical axial section through a first lock according to the present invention, of the tubular type, mounted on a opening element, such as a door, and in the position of rest.
Figure 4:
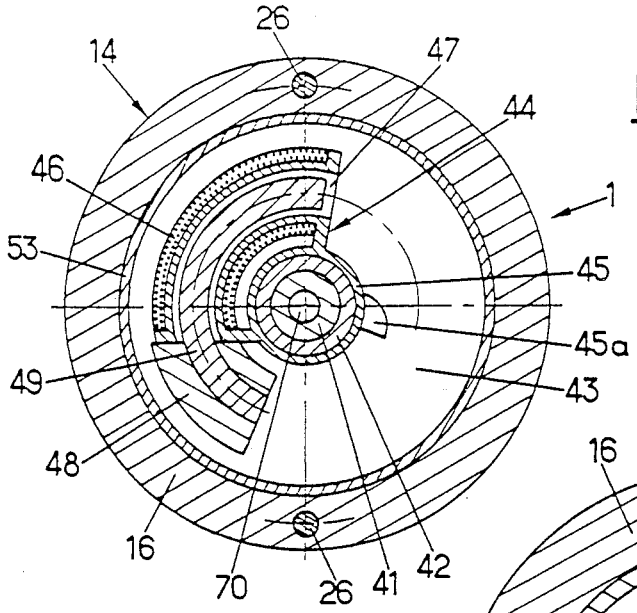
Figure 5:
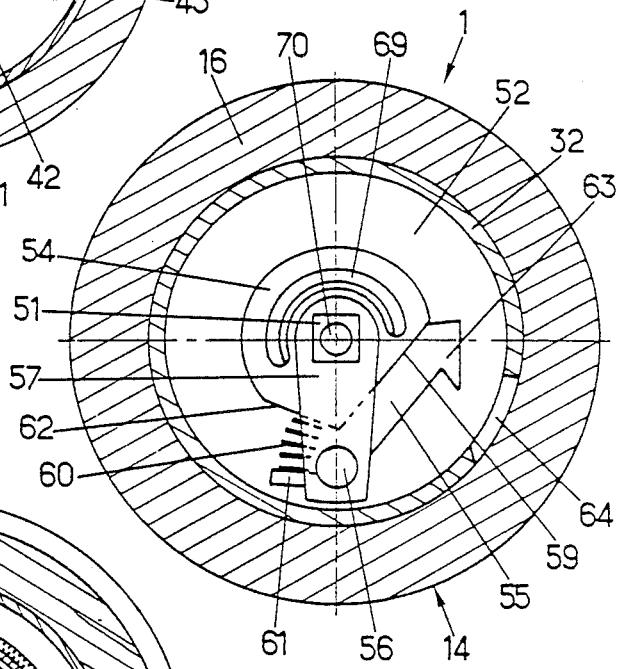
Figure 6:
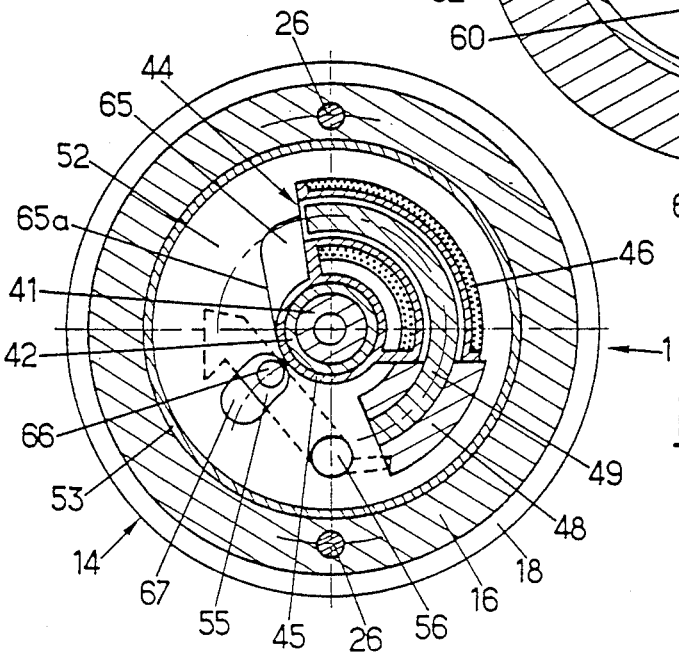
Figure 7:
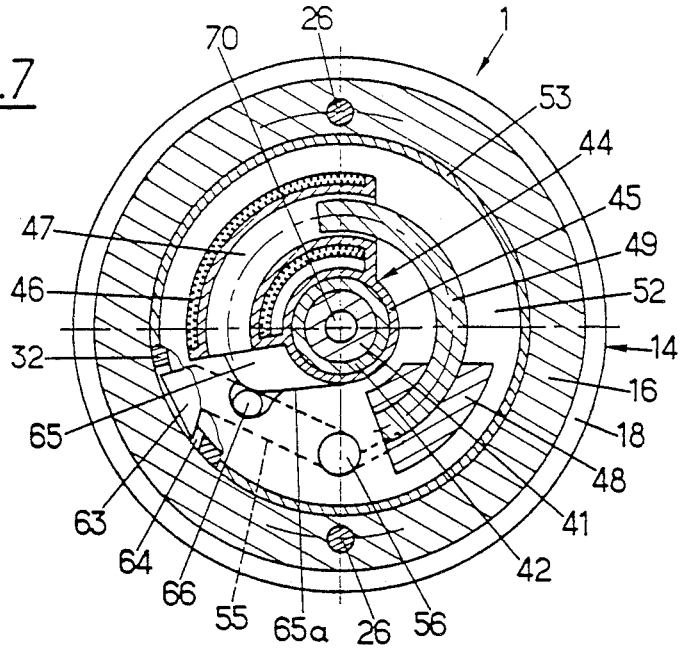
Figure 8:
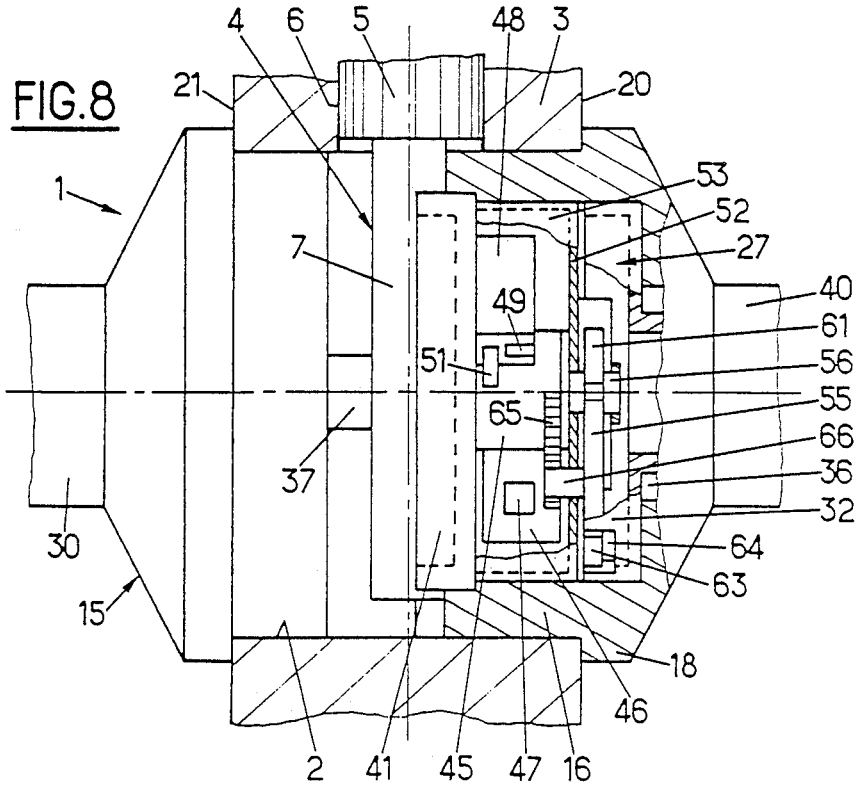
Figure 9:
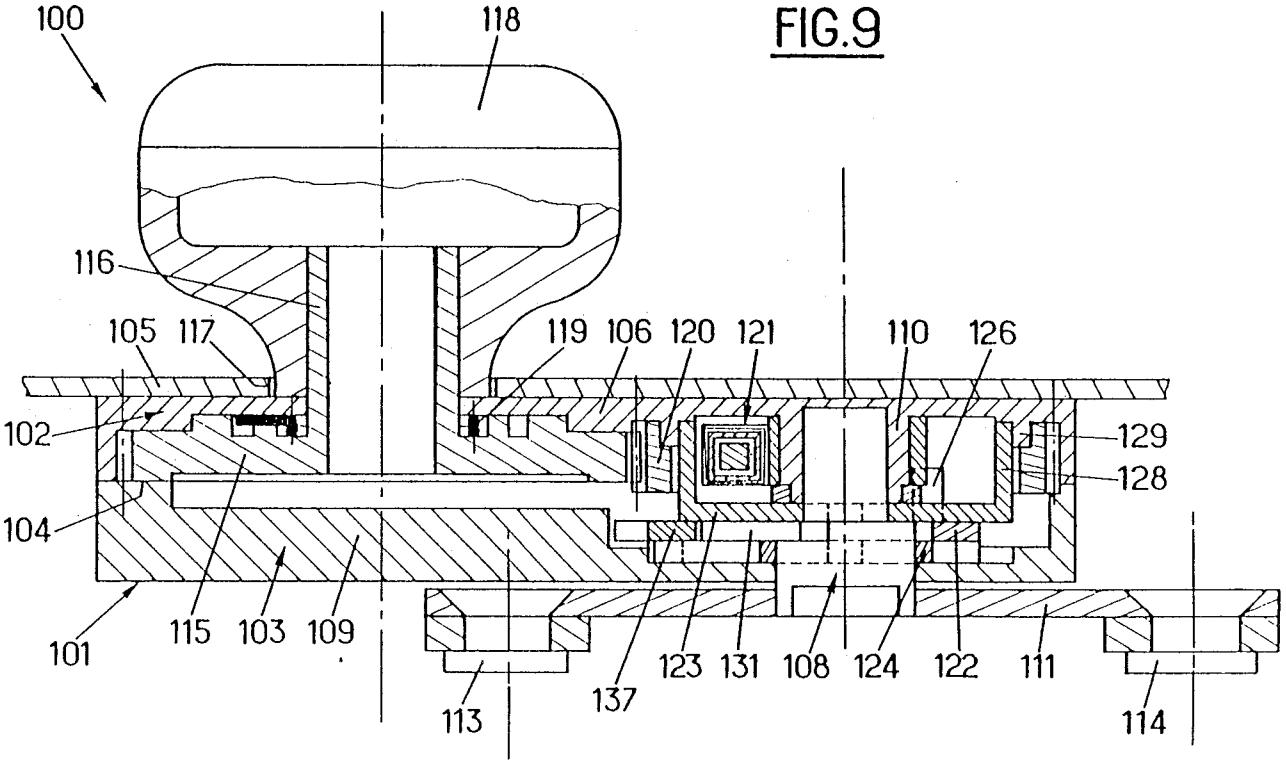
Figure 10:
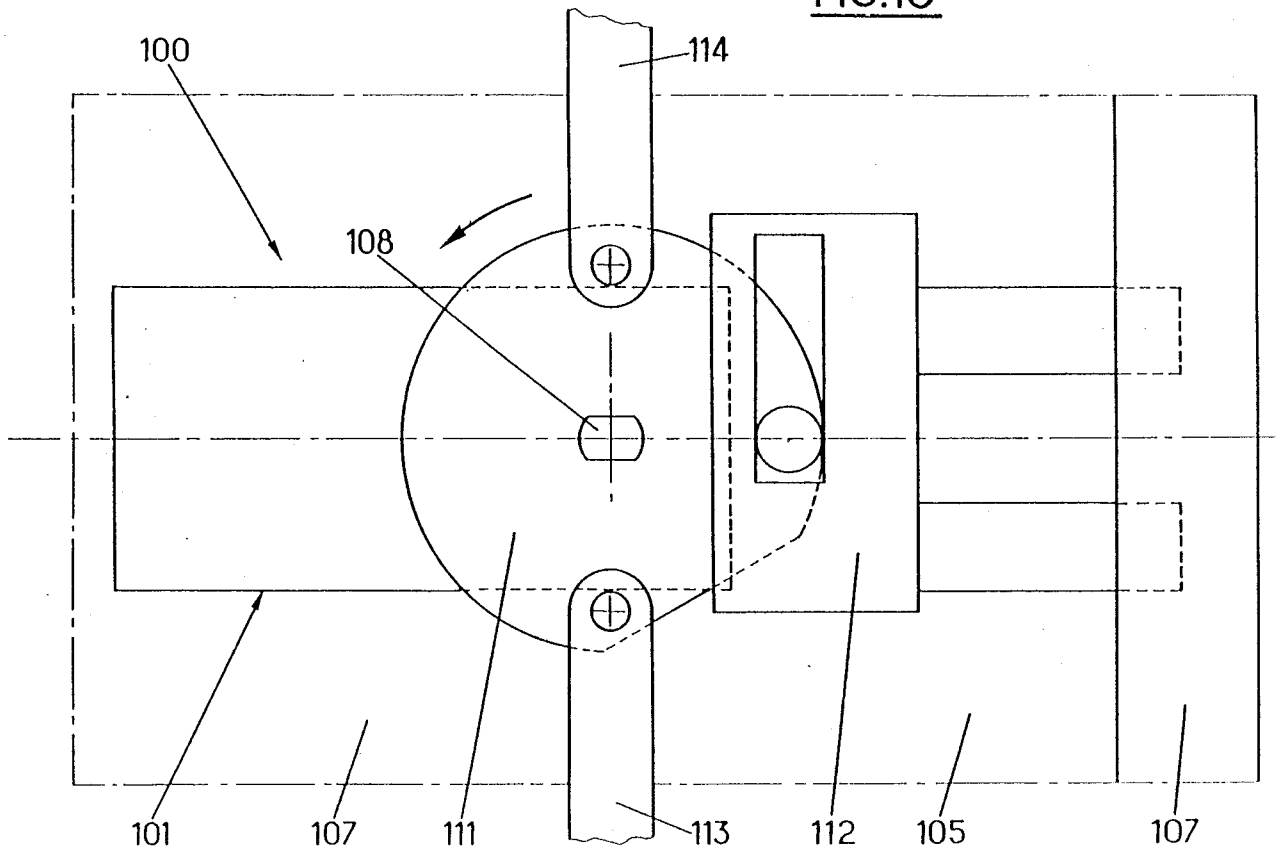
Figure 11:
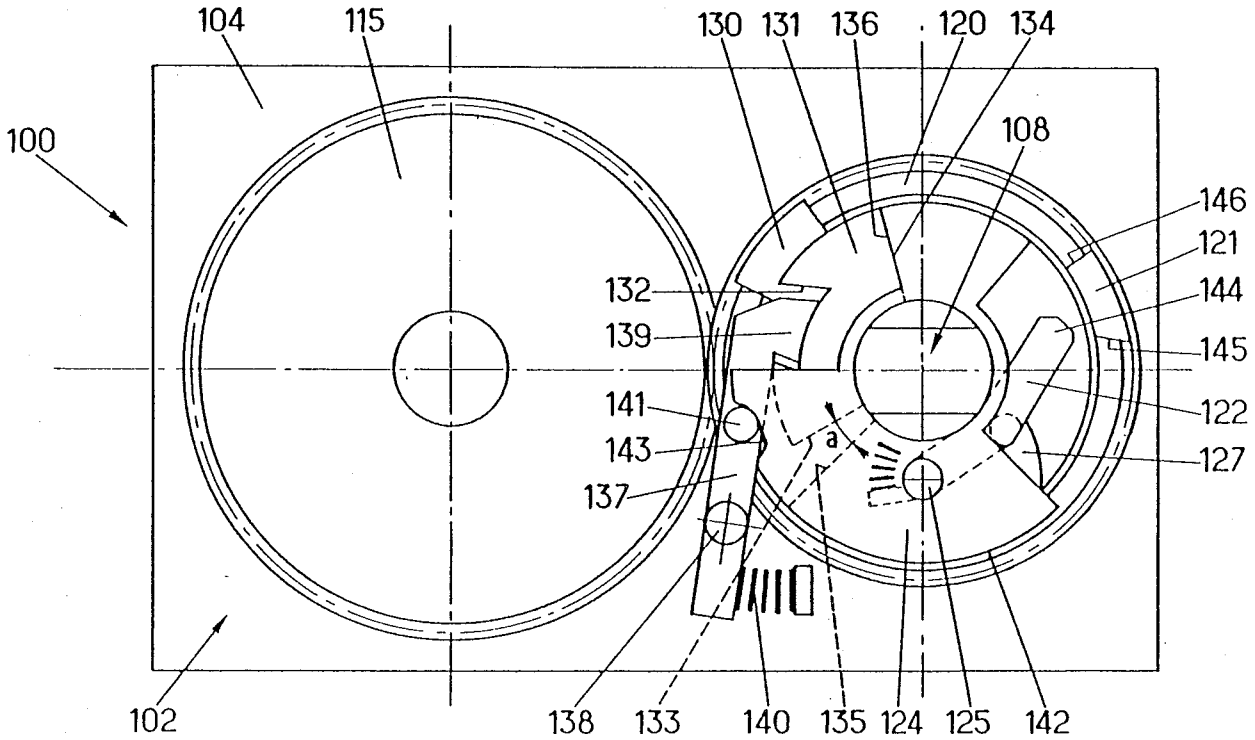
Figure 12:
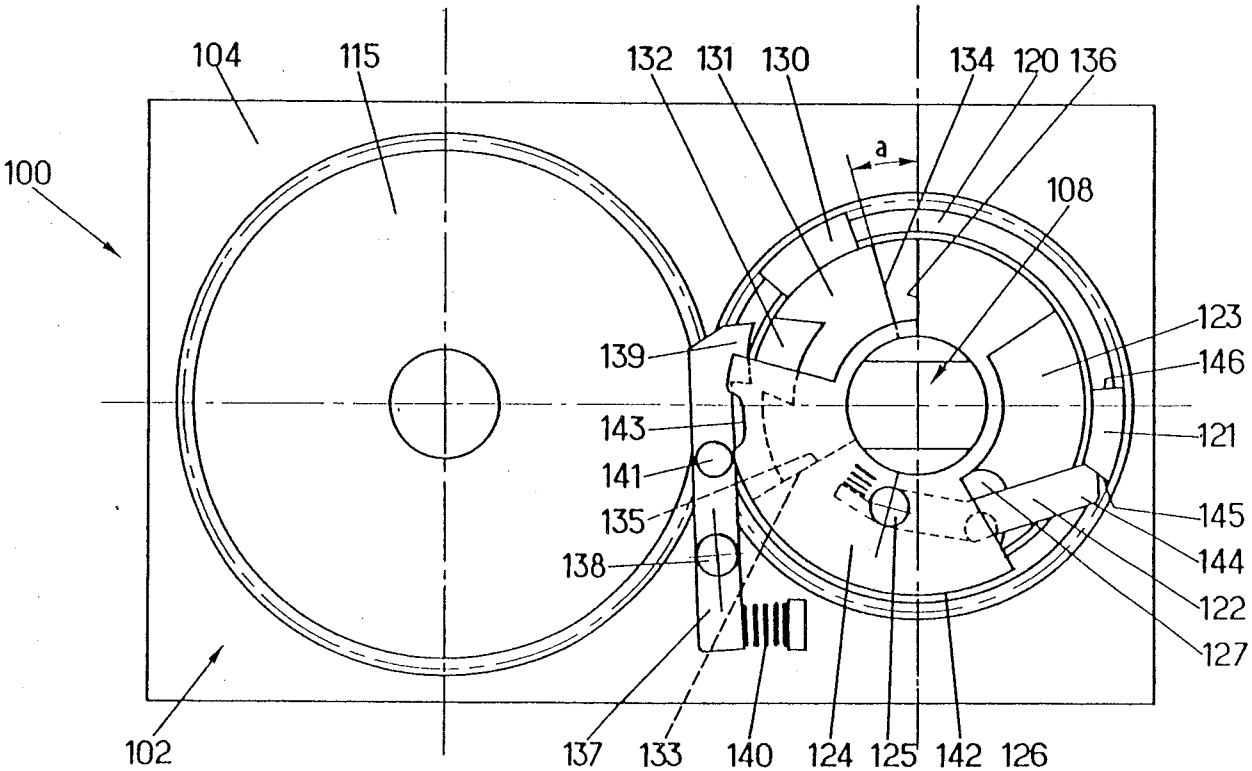
Figure 13:
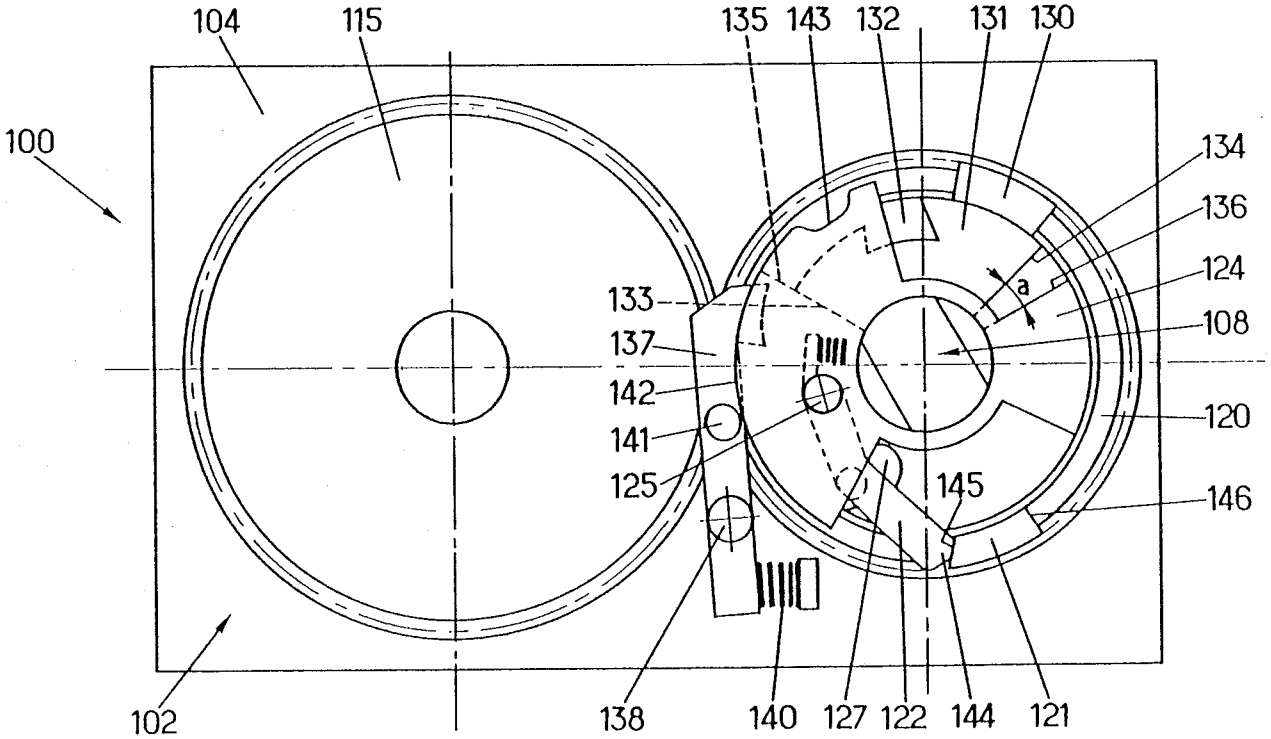
Figure 14:
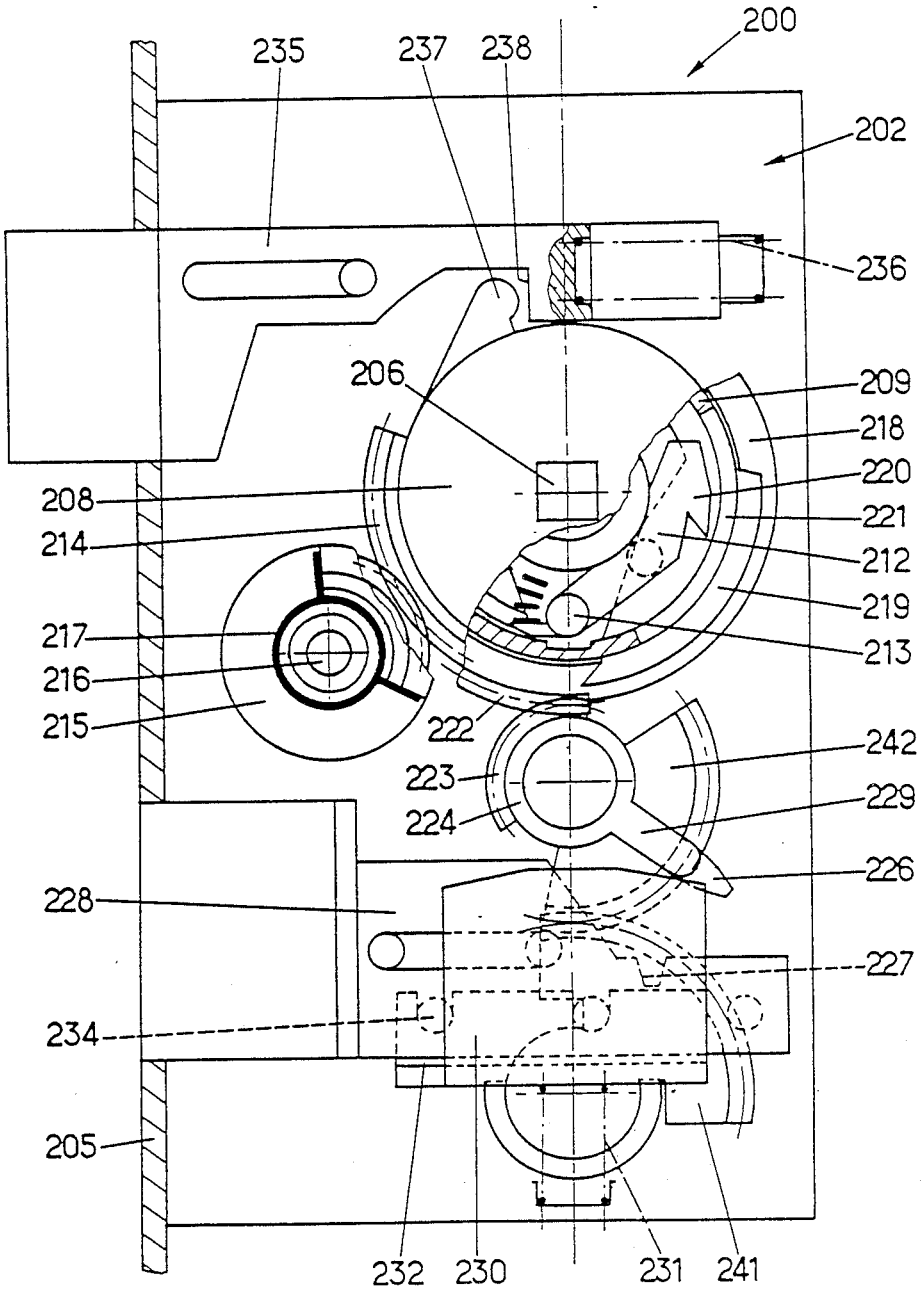
Figure 15:
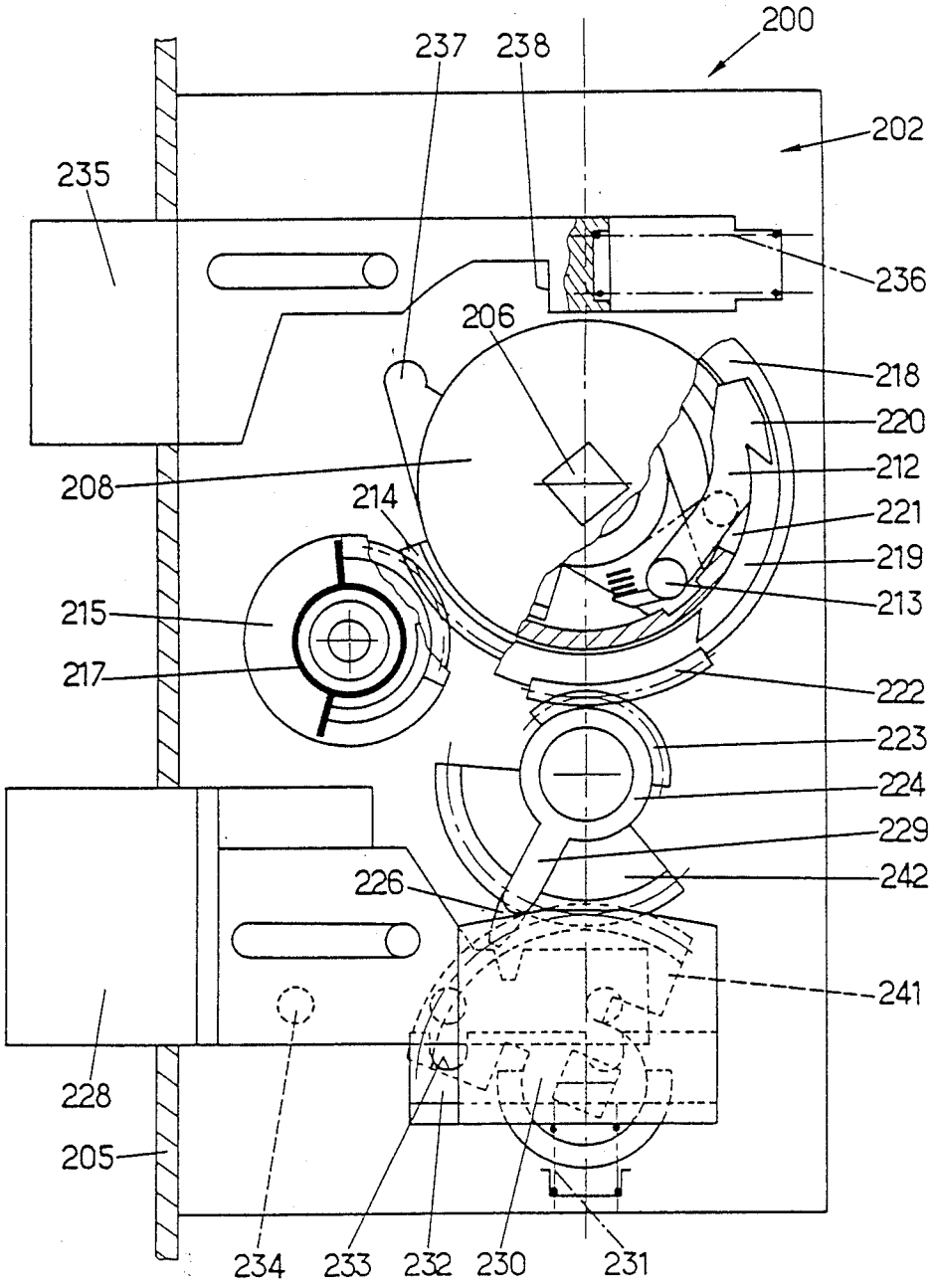
Figure 16:
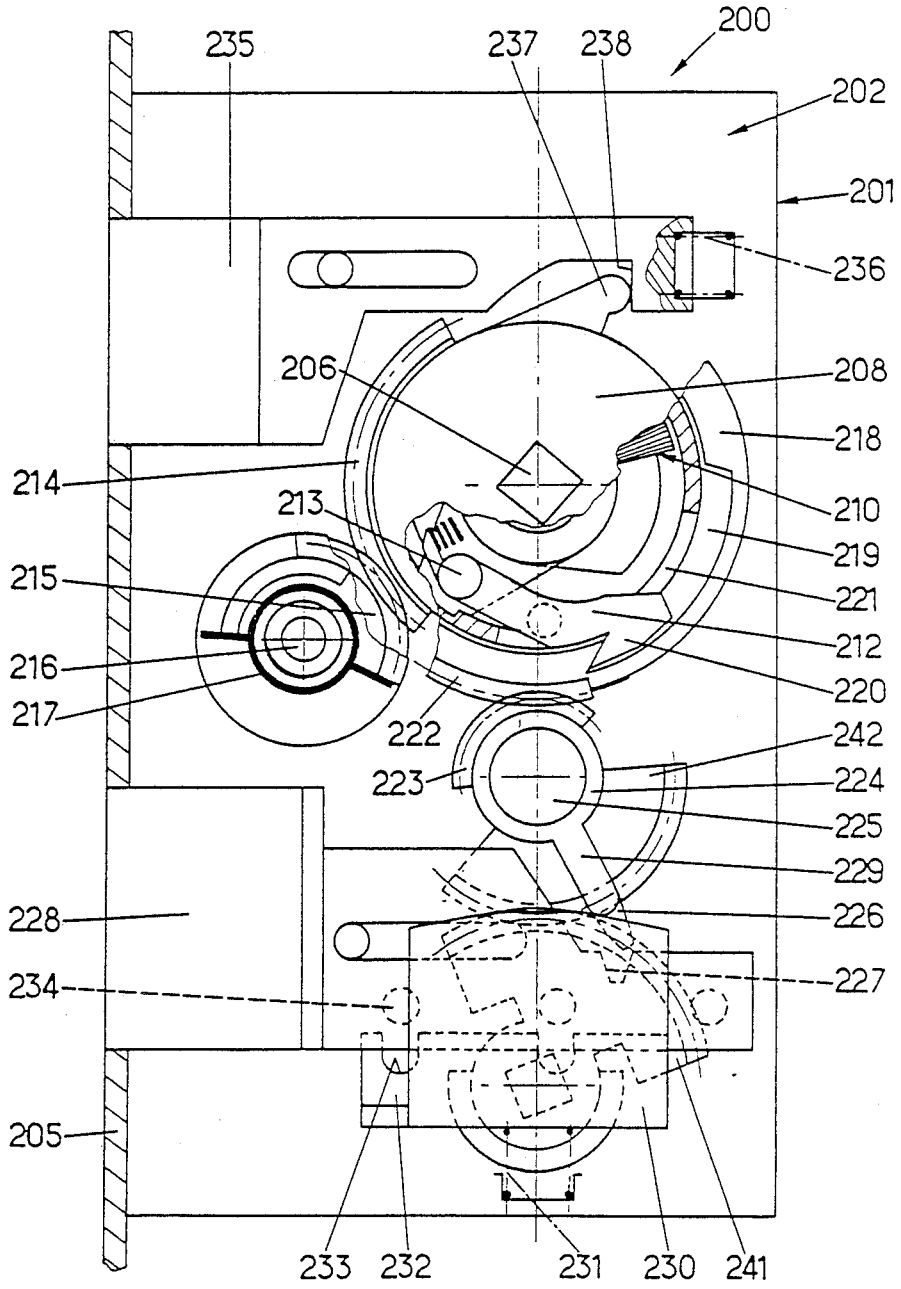

FIG. 4 a section along the line IV—IV of the lock illustrated in FIG. 1, in the position of rest;

FIG. 5 a radial section along the line V—V of the lock of FIG. 1, in the position of rest;

FIG. 6 a radial section along the line VI—VI of the lock of FIG. 1, in the position of rest;

FIG. 7 a radial section along the line VI—VI of the lock of FIG. 1, in the set position;

FIG. 8 shows a cutaway bottom view of the lock of FIG. 1, in the set position;

FIG. 9 shows a horizontal axial section through a second lock according to the present invention, of the built-on type, in the opening position;

FIG. 10 shows an outside elevation view of the lock illustrated in FIG. 9, mounted on an opening element;

FIG. 11 shows an inside elevation view of the lock of FIG. 9, in the position of rest;

FIG. 12 shows an inside elevation view of the lock of FIG. 9, in the position at the start of opening;

FIG. 13 shows an inside elevation view of the lock of FIG. 9, in the position at the end of opening;

FIG. 14 an inside elevation view of a third lock according to the present invention, of the mortise type, in the unlocked position;

FIG. 15 shows the lock of FIG. 14, in the locked position;

FIG. 16 shows the lock of FIG. 14, in the final unlocking position; and

Figure 17:
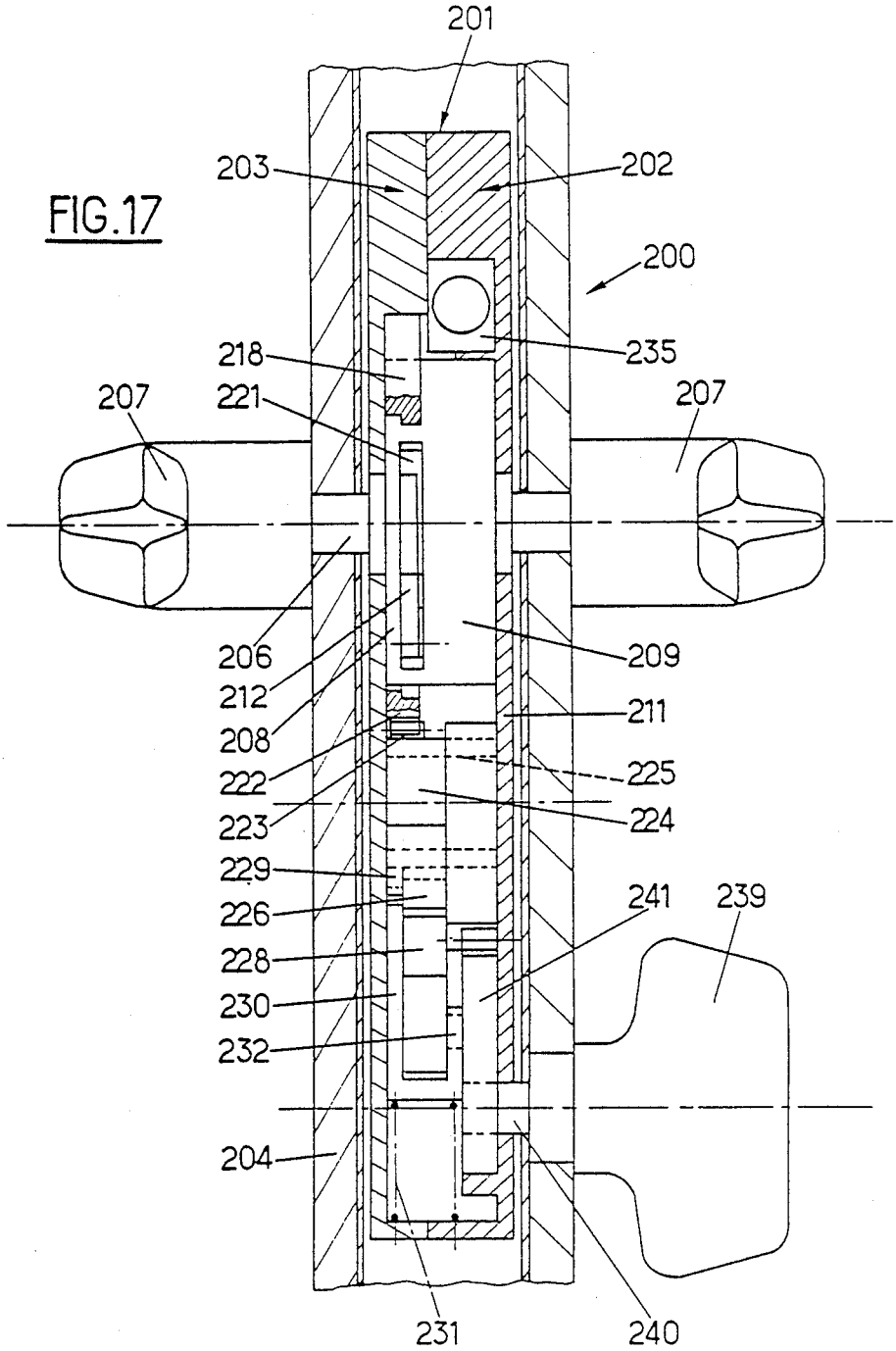

FIG. 17 shows the lock of FIG. 14 in an inside rear view.

The lock with electrically controlled setting and with manual actuation illustrated in FIGS. 1 to 8 and designated as a whole by the reference 1 is mounted in a cylindrical passage 2 of an opening element, such as a door 3, this cylindrical passage being perpendicular to its plane.

As can be seen in FIGS. 1, 2 and 8, the lock 1 is associated with a locking device designated as a whole by he reference 4, which extends horizontally and in the mid-plane of the door 3 perpendicularly to the cylindrical passage 2. This locking device 4 comprises a cylindrical part 5 extending in a cylindrical passage 6 of the door 3 and, at the inner end of the latter, a part of rectangular cross-section 7 extending in the cylindrical passage 2 of the door 3 radially and, at its front end, a sheet 8 fastened to the vertical edge 9 of the door 3.

This locking device 4 comprises a bolt 10 which is movable in translation between an extended position and a retracted position perpendicular to the edge 9 of the door 3 and which, in order to move it, is connected to a ring 11 capable of being driven in rotation in the axis of the cylindrical passage 2 of the door 3 by means of a movement-converting mechanism not shown in the figures and moreover well known.

The ring 11, in order to drive it in rotation, has a rectangular passage 12, the axis of which extends in the axis of the cylindrical part 2 of the door 3.

With particular reference to FIGS. 1, 3 and 8, it will be seen that the lock 1 has a hollow lock body designated as a whole by the reference 13 and comprising two parts 14 and 15 in the form of opposing cups. These lock bodies 14 and 15 have respectively cylindrical parts 16 and 17 which fit exactly into the cylindrical passage 2 of the door 3 and which are equipped with peripheral shoulders 18 and 19 coming up against the opposite faces 20 and 21 of the door 3. The lock bodies 14 and 15 also have, at the outer end of their outer parts 16 and 17, radial flanges 22 and 23 which are provided with axial passages 24 and 25 and the outer face of which is in the form of a truncated cone.

Moreover, the lock bodies 14 and 15 are joined together by means of two diametrically opposite screws 26 which pass through the cylindrical part 17 of the lock body 15 and which are screwed into the cylindrical part 16 of the lock body 14, in such a way that their shoulders 18 and 19 are held firmly up against the opposite faces 20 and 21 of the door 3. The inner end of the cylindrical part 16 of the lock body 14 also has two diametrically opposite notches 16*a* and 16*b*, in which extends the part 7 of the locking device 4, as can be seen clearly in FIG. 2.

The lock 1 also has two rotary coaxial components 27 and 28.

The component 27 is mounted rotatably in the lock body 13 and comprises, in succession, a cylindrical part 29 which is mounted rotatably via the axial passage 24 of the lock body 14 and the outer end of which carries an outer actuating handle 30, a radial part 31 adjacent to the radial inner face of the flange 22 of the lock body 14, and a cylindrical part 32 which extends inwards and which is mounted rotatably in the cylindrical part 16 of the lock body 14.

With particular reference to FIG. 3, it will be seen that the inner face of the flange 22 of the lock body 14 has a recess 33 over part of its periphery, and the radial part 31 of the component 27 has a projecting part 34 which penetrates into this recess 33, in such a way that the component 27 and the handle 30 which it carries can pivot between two end positions, in which the projecting part 34 comes up against the ends of the recess 33.

Moreover, as can be seen in FIG. 1, a spring 35 with a circular action is arranged in an annular recess 36 of the axial passage 24 of the flange 22 of the lock body 14, this spring 35 being connected on the one hand to the lock body 14 and on the other hand to the component 27, so as to stress the component 27 and the handle 30 towards an angular centre position.

With particular reference to FIG. 1, it will be seen that the component 28 is formed by an axial shaft having a part 37 of rectangular cross-section, which extends through the passage of rectangular cross-section 12 of the locking device 4, so as to be connected in terms of rotation to the actuating ring 11. The part of square cross-section 37 of the shaft 28 also extends axially in a component 38, with which it is integral in terms of rotation and which is mounted on the lock case 15 in the same way as and opposite to the preceding component 27 on the lock body 14, with a helical restoring spring 39 and angular stops being provided as before, and which, at its outer end, carries an inner handle 40 opposite the outer handle 30.

As can be seen particularly clearly in FIG. 1, the shaft 28 has, on the other side of the locking device 4, a cylindrical part 41 mounted rotatably in a cylindrical sleeve 42 extending on the same side as the outer handle 30 from a fixed plate 43, the periphery of which is carried by the inner end of the cylindrical part 16 of the lock body 14, this plate 43 being adjacent to the part 7 of the locking device 4 and its peripheral edge having an annular rim possessing two notches 43*a* and 43*b* corresponding to the notches 16*a* and 16*b* of the lock body 14.

Mounted round the sleeve 42 is a rotary support 44 which will be called a coil-holder and which comprises a bush 45 carrying, at a distance and on its periphery, a coil 46 in the form of a hollow ring segment with an annular passage 47.

That face of the stationary plate 43 located on the same side as the sleeve 42 which it carries has a projecting part 48 which is located in its lower part and on which is mounted the lower end of a magnet 49 which is in the form of a ring segment and which is inserted into the annular passage 47 of the coil 46. Furthermore, the end of the sleeve 42 opposite the plate 43 carries a stop ring 50 forming a stop for the coil-holder 44 in terms of translational movement.

The coil-holder 44 rotates between two substantially symmetrical angular end positions located on either side of its top dead centre. In one of its end positions, called the "position of rest", one of the ends of the coil 46 is up against one end of the projecting part 48 of the plate 43, this position being visible in FIGS. 4 and 6. In its other end position, called the "active position", a stop 45*a*, carried by the outer face of the bush 45 on the same side as the plate 43, is up against the other end of the projecting part 48 of the plate 43, this position being visible in FIGS. 7 and 8. In the example, the coil 46 extends substantially over a quarter circle and the angular extent of its movement is substantially 90°.

The end of the shaft 28 located on the same side as the handle 30 and at the end of its cylindrical part 41 has a part 51 of square cross-section which is arranged outside the sleeve 42 and on which is fastened a radial plate 52 which consequently rotates together with the shaft 28. This radial plate 52, on its periphery, has a cylindrical part 53 which is mounted rotatably, to form a bearing, in the cylindrical part 16 of the lock body 14 between the cylindrical part 32 of the component 27 and the radial plate 43, this cylindrical part 53 extending in the direction of the plate 43. Moreover, the plate 52 has a central annular boss 54 on its face turned towards the handle 30. It will thus be seen that the coil 46 and the magnet 49 of the projecting part 48 extend between the stationary plate 43 and the rotary plate 52.

A connecting element consisting of a hook 55 is mounted on the outer face of the plate 52. The lower end of this hook 55 has a pivot pin 56 which is eccentric relative to the main axis of the lock and of which one of the ends is mounted rotatably in the plate 52 between its annular boss 54 and its peripheral edge and the other end is mounted rotatably in a sheet 57 fastened to the face of the annular boss 54 turned towards the handle 30 and to a boss 58 of the plate 52, in such a way that the hook 55 is movable in a radial plane. As can be seen in FIG. 5 in particular, the hook 55 is articulated on the lower part of the plate 52 and at rest extends opposite the coil 46.

The hook 55 is stressed towards a so-called retracted position, in which it is up against one face 59 of the projecting annular boss 54, by means of a spring 60 which acts between an extension 61 of the hook 55 located on the other side of its pivot pin 56 and a face 62 of the annular boss 54.

After it has been noted that the inner end of the cylindrical part 32 of the component 27 is adjacent to the peripheral edge of the plate 52, it will be seen particularly in FIG. 6 that the free end 63 of the hook 55, when the latter is in its retracted position, is at a distance from the inner face of the cylindrical part 32 of the component 27.

As can be seen especially clearly in FIG. 7, in another position, called the active position, the hook 55 is pivoted radially outwards about its pivot pin 56, in such a way that its free end 63 enters a notch 64 of the cylindrical part 32 of the component 27, in order, by means of the hook 55 and the plate 52, to connect the outer handle 30 to the actuating shaft 28 of the locking device 4 in terms of rotation.

As can be seen in FIGS. 6 to 8, the coil-holder 44 has a cam 65 which extends from its bush and which is adjacent to the face of the plate 52 turned towards the plate 43.

The hook 55 carries a finger 66 which extends through an oblong passage 67 made in the plate 52 and in the space separating this plate 52 and the plate 43. The active face 65*a* of the cam 65 is such that, when the coil-holder changes from its position of rest to its active position, the hook 55 changes from its retracted position to its active position, in which its free end 63 is engaged, in the notch 64, with the cylindrical part 32 of the component 27. Their positions of rest can be seen especially in FIG. 6, whilst their active positions can be seen in FIGS. 7 and 8.

Moreover, the wires 68 supplying electrical energy to the coil pass between the projecting annular boss 54 of the plate 52 and the end of the cylindrical part 41 of the shaft 27 and through a semi-annular passage 69 in the radial part of this projecting part 54 of the rotary plate 52.

The lock with electrically controlled setting and with manual actuation 1, which is illustrated in FIGS. 1 to 8 and described above, operates in the following way.

Since the inner handle 40 is permanently connected to the locking device 4 by means of the part 37 of rectangular cross-section of the shaft 28, it is possible, by rotating this handle 40 in one direction or the other counter to the spring 39, to actuate the bolt 10 of the locking device 4, and the plate 52 carrying the hook 55 rotates at the same time, remaining in its retracted position. Between each actuation, the shaft 28, the handle 40 and the plate 52 return to an intermediate angular position by means of the spring 39 and, if appropriate, the restoring spring of the locking device 4. During this actuation of the inner handle 40, the coil-holder 44 and the coil 46, being in the state of rest, are not stressed.

In the state of rest of the coil-holder 44 described above, in which the hook 55 is in its retracted position, the outer handle 30 and consequently the component 27 can be rotated in one direction or the other, without thereby actuating the locking device 4, and the handle 30 and the component 27 return to an intermediate angular position between each actuation.

When a suitable electrical pulse is transmitted to the coil 46 via the supply wires 68, the coil-holder 44 is consequently made to rotate about the sleeve 42 from its position of rest to its active position. During this rotation, the active face 65*a* of the cam 65 carried by the coil-holder 44 pushes the finger 66 of the hook 55 outwards and consequently causes the latter to pivot about its pivot pin 56 up to its active position, in which its upper end 63 is engaged in the notch 64 of the cylindrical part 32 of the component 27. In this active position, the handle 30 is connected in terms of rotation to the locking device 4 by means of the component 27, the hook 55, the plate 52 and the shaft 28. The lock 1 is then in its set position.

If the outer handle 30 is rotated in one direction or the other, the locking device 4 can then be actuated, consequently causing its bolt 10 to move. In one direction of rotation, the hook 55 is pulled, whilst in the other it is pushed.

To prevent the end 63 of the hook 55 from escaping from the notch 64 during these movements, the bearing faces of the end 63 of the hook 55 and the peripheral end surfaces of the notch 64 are in such angular positions that the end 63 tends to enter the notch 64 and not escape from it.

When the coil-holder 44 is in its active position, its unbalance can make it possible to keep the hook 55 in its active position, so that there is no need to maintain the electrical pulse in the coil 46. To return the coil-holder 44 to its position of rest, after a specific time sufficient for operating the handle 30 and actuating the locking device all that is necessary is to transmit a new reverse pulse to the coil 46. When the coil-holder 44 has returned to its position of rest, it is nevertheless possible to continue the actuation of the locking device 4, because the end 63 of the hook 55 is held up against one of the ends of the notch 64 of the cylindrical part 32. However, as soon as the outer handle 30 is released, the hook 55 returns to its retracted position under the action of the spring 60, and the lock resumes its inactive position, in which the rotation of the outer handle 30 does not cause the locking device 4 to be actuated.

To generate the electrical pulses intended for actuating the coil-holder 44 by means of the electromagnet consisting of the coil 46 and the magnet 49, there can be electronic circuits for identifying electronic keys which can be arranged in the handle 30 and/or in the handle 40, these handles being made hollow and the shaft 28 having an axial passage 70 allowing electrical wires to pass from one of the handles to the other.

With reference to FIGS. 9 to 13, another lock with electrically controlled setting and with manual actuation, designated as a whole by the reference 100, will now be described.

This lock 100 comprises a hollow parallepipedic casing 101 having a first part 102 and a second part 103 with a vertical joining plane 104. This lock casing 101 is built onto the inner face of an opening element, such as a door 105, in such a way that the vertical wall 106 of the part 102 is up against its inner face.

In its part located on the same side as the vertical upright 107 adjacent to the edge of the door 105, the lock 100 has a horizontal transverse spindle 108 which extends through the vertical wall 109 of the body part 103 and which also extends within an annular sleeve 110 projecting on the vertical wall 106 of the body part 102, this horizontal spindle 108 being mounted so as to rotate freely. It may be seen that the sleeve 110 and the vertical wall 106 of the body part 102 are equivalent to the sleeve 42 and to the plate 43 of the lock illustrated in FIGS. 1 to 8.

Mounted on the end of the horizontal spindle 108, outside the lock body 101, is a vertical plate 111 which, as can be seen in FIG. 10, makes it possible, during the rotation of the spindle 108, to actuate a system of bolts comprising a horizontal bolt 112 and two vertical bolts 113 and 114 as a result of rotation in one direction of the arrow for opening or in the other direction for locking.

The lock 100, in its part remote from the fixed vertical upright 107, has an externally toothed wheel 115 mounted rotatably within the body part 102 in an axis parallel to the axis 108. This gearwheel 115 has a projecting cylindrical part 116 which extends through the vertical wall 106 and through a passage 117 made in the door 101, this projecting annular part 116 carrying an actuating handle 118 outside the door 108. Furthermore, the gearwheel 115 is subjected to a helical spring 119 which stresses the latter and the handle 118 towards an intermediate stable position, and stops preventing rotation, not shown in the figures, are provided in order to limit their rotational movement in both directions, as in the preceding example.

Mounted freely in terms of rotation in the lock body 101 coaxially relative to the shaft 108 is a ring 120 toothed on its periphery and meshing with the gearwheel 115, this toothed ring 120 possessing laterally, on the same side as the body part 10, a projecting part 121 forming a stop.

As in the preceding example, the lock 100 has an electromagnet designated as a whole by the reference 121, of which the coil-holder and the magnet are mounted respectively on the sleeve 110 and on the vertical wall 106 of the body part 102, and an articulated arm 122 equivalent to the hook 55. This hook 122 extends between two plates 123 and 124, on which it is articulated eccentrically by means of a pivot pin 125, these plates being mounted freely in terms of rotation on the spindle 108, and the arm 122 carrying a lateral finger 126 which passes through an oblong passage 127 made in the plate 123 and extends in the path of the cam of the coil-holder of the electromagnet 121, as before. Moreover, the plate 123 adjacent to the end of the sleeve 110 has, on its periphery, an annular part 12 which extends between the annular path of the coil-holder of the electromagnet 121 and the toothed ring 120 and which is mounted rotatably in an annular part projecting from the vertical wall 105 of the body part 102. The plate 123 also has, on its periphery, a projecting part forming a stop 130.

Between the plates 123 and 124, the spindle 108 carries a plate sector 131 which has a notch 132 on its periphery. This plate sector 131 has two opposite radial faces 133 and 134 capable of coming respectively up against two radial surfaces 135 and 136 of the double plates 123 and 124, an angular play a being provided.

A locking hook 137 articulated by means of a horizontal pivot pin 138 mounted on the body 101 has a free end 139 designed to enter the notch 132 of the plate sector 131 connected to the spindle 108, so as to lock the latter in terms of rotation. The hook 138 is stressed towards this locking position by a spring 140 and carries laterally a finger 141 which extends on the periphery of a cylindrical surface 142 of the plate 124, a notch 143 being made in the surface 142.

The lock 100 illustrated in FIGS. 9 to 12 operates in the following way.

With the bolts 112, 113 and 114 being in their locking position, as illustrated in FIG. 10, that is to say in the extended position, the lock 100 is in the following state shown in FIG. 11. The handle 118 is in its intermediate position of rest, and the stop 121 of the toothed ring 120 connected to the handle 118 by means of the gearwheel 115 is likewise in an intermediate angular position of rest. The connecting arm 122 is in its retracted position. The end part 139 of the locking lever 137 is engaged in a notch 132 of the plate sector 131 carried by the spindle 108, so that the latter is locked and keeps the bolts 112, 113 and 114 locked. The face 136 of the plate sector 131 is up against the face 134 of the double plates 123, 124, in such a way that their faces 133 and 135 are at a distance and separated by the angular play a. The lateral finger 141 of the locking lever 137 is engaged in the notch 143 made on the periphery of the sector-shaped plate 124. The bolts 112, 113 and 114 are locked and the handle 118 can be pivoted in one direction or the other without having any effect, the toothed ring 120 pivoting at the same time.

As in the preceding example, when a pulse is transmitted to the electromagnet 121, the connecting arm 122 is consequently pivoted outwards towards its active position, in which its end 144 comes opposite the end 145 of the stop 121 carried by the toothed ring 120. When the handle 118 is rotated in a first direction from its position of rest, the toothed ring 120 connected to the handle 118 by means of the gearwheel 115 consequently drives the double plates 121, 124 in rotation by means of the connecting arm 122. At the same time, in a first phase of movement, the finger 141 of the locking lever 137 leaves the notch 143 and comes up against the peripheral surface 142 of the sector-shaped plate 124, in such a way that the end 139 of the locking lever 137 leaves the notch 132 of the sector-shaped plate 131 carried by the spindle 108, so that the latter is released, and at the same time the radial face 135 located between the double plates 123 and 124 is brought up against the face 133 of the sector-shaped plate 131 as a result of the compensation of the play a.

If the rotational movement is continued, the spindle 108 is driven in rotation until the gearwheel 115 comes up against one of its stops, the bolts 112, 113 and 114 at the same time being brought into their retracted position as a result of the rotation of the plate 111, to which they are connected. FIG. 12 shows the lock at the end of the first phase of the rotational movement, the lever 137 being released, and FIG. 13 shows the lock 100 at the end of the movement of the bolts towards their retracted position.

When the handle 118 is released, it returns to its intermediate position of rest, and the stop 121 carried by the toothed ring 120 at the same time returns to its intermediate position of rest, in which the opposite face 146 of the stop 121 comes up against the stop 130 located on the periphery of plate 121, an electrical pulse in the opposite direction being transmitted to the electromagnet, as in the preceding example, and the connecting arm 122 returning to its retracted position.

To return the bolts 112, 113 and 114 to their advanced locking position, the handle 118 is rotated in its other direction of rotation. The stop 121 of the toothed ring 120 causes the double plates 123, 124 to rotate because it bears against the stop 130 by means of its end 146. After the angular play a has been compensated, the radial face 136 of the double plates 123, 124 comes up against the radial face 134 of the plate sector 131 connected to the spindle 108, and this spindle 108 is thus driven in rotation. When the handle 118 reaches the end of its travel, where the gearwheel 115 comes to a stop, the lock 100 resumes the state illustrated in FIG. 11 described above, in which the spindle 108 connected to the bolts 112, 113 and 114 is locked by means of the locking lever 137 and these bolts are in their extended position.

It will therefore be seen that, as in the example described with reference to FIGS. 1 to 8, the connecting arm 122 is carried by a component which consists of the double plates 123 and 124 and which is connected to the bolts 112, 113 and 114, and that the end of this connecting arm 122 interacts with a component consisting of the toothed ring 120 which is connected to the handle 118. However, in the lock 100, the axis of the handle 118 is offset relative to these two coaxial components 120 and 123, 124, and there is also a bolt-locking system which is stressed by means of the connecting arm 122.

Referring now to FIGS. 14 to 17, a lock designated as a whole by the reference 200 will be described.

As can be seen in FIG. 17, this lock 200 is of the mortise type with two bolts. It comprises a lock body designated as a whole by the reference 201 and of parallelepipedic shape, possessing two opposite parts 202 and 203 having a vertical joining plane extending parallel to the plane of an opening element, such as a door 204, in which the lock body 201 is flush-mounted, this lock body 201 being equipped with a sheet 205 fastened to the edge of the door 204.

In its upper part, the lock body 201 has passing through it a square spindle 206, the ends of which carry two opposite crutch handles 207 on either side of the door 204.

A radial plate 208 mounted on the square spindle 206 in the lock body 201 possesses laterally a cylindrical annular part 209 which is mounted rotatably in the body part 202.

As in the preceding example, inside the cylindrical part 209 there is an electromagnet 210, the coil-holder of which is mounted rotatably on a sleeve projecting from the vertical wall 211 of the body part 202 and the electromagnet of which is fastened to the latter. Moreover, the plate 208 connected to the spindle 206 carries, on the same side as the cylindrical part 209, a connecting arm 212 which is articulated eccentrically by means of a pivot pin 213.

The cylindrical part 209 has, over some of its circumference, a toothed part 214 which is engaged with a gearwheel 215 mounted on a spindle 216 parallel to the spindle 206, this gearwheel 215 being stressed by a helical spring 217 towards a stable intermediate position. Moreover, the angular travel of this gearwheel 215 on either side of its position of rest is limited by stops (not shown). Thus, the spindle 206 carrying handles 207 has an intermediate position of rest and can be pivoted in both directions up to the stops associated with the gearwheel 215.

Round the cylindrical part 209 and facing the connecting arm 212, there is a ring 218 which is mounted rotatably in the body part 203 and which has an inner recess 219, into which the free end 220 of the hook 212 can penetrate, the cylindrical part 209 carried by the plate 208 having a passage 221 for the connecting arm 212.

The annular ring 218, in its lower part, has a toothed part 222 which is engaged with the toothed part 223 of a ring 224 mounted rotatably on a horizontal spindle 225 carried by the body parts 202 and 203.

The ring 224 carries a finger 226 which extends downwards and the end of which is capable of entering a notch 227 in a locking bolt 228 and, during its rotation in one direction or the other, of shifting this bolt 228 horizontally between an extended position and a retracted position perpendicularly to the spindle 206.

The ring 224 also carries a finger 229 which extends downwards and which, during its rotation, is capable of acting on a sheet 230 stressed upwards by a spring 231, this sheet 230 being mounted so as to vertically movably in the lock body 201 and having, on the other side of the bolt 228, another vertical sheet 232, in which there are notches 233, these notches being designed to receive studs 234 carried laterally by the bolt 228 when the sheets 230 and 232 are in their upper position. The system composed of the sheets 230 and 232 and of the studs 234 is a system for locking the bolt 228 in its extended position and in its retracted position.

Furthermore, the lock 200 has a second bolt 235 parallel to the bolt 228 and stressed towards its extended position by a spring 236. This bolt 235 is capable of being brought from its extended position to its retracted position by means of a finger 237 located on the periphery of the cylindrical part 208 connected to the spindle 206, whenever the crutch handles 207 are moved downwards, the finger 237 interacting with a vertical face 238 provided in the bolt 235.

The lock 200 illustrated in FIGS. 14 to 17 operates in the following way.

In the position illustrated in FIG. 14, the connecting arm 212 is in its position of rest, and the bolt 218 is in its retracted position and is locked by means of the plate 232 which is in its upper position and which interacts with the lateral fingers 234 of this bolt.

If the handles 207 are pivoted upwards counter to the spring 217, nothing happens. In contrast, if the handles 207 are pivoted downwards, the bolt 235 is shifted from its extended position towards its retracted position counter to the spring 236. It is then possible to use the lock 200 in the conventional way to open or close the door 204.

From the position illustrated in FIG. 14, an electrical pulse is transmitted to the electromagnet 210, and as in the preceding examples the latter shifts the connecting arm 212 from its retracted position towards its active position, in which its end 220 enters the recess 219 provided in the cylindrical ring 218. When the handles 207 are pivoted upwards, the end 210 of the connecting arm 212 consequently comes up against one of the ends of the recess 219, and this is driven in rotation and drives the ring 224 in rotation. At the same time, in a first phase, the finger 225 carried by the ring 224 pushes the sheet 232 downwards by acting on the upper edge of the sheet 230 and causes the bolt 228 to be released, and in a second phase the finger 226 engages into the notch 227 of the bolt 228 and causes it to move towards its extended position. At the end of travel, the sheet 230 is moved upwards again, in such a way that the sheet 232 reengages with the fingers 234. The bolt 228 is then locked in its extended position. This state of the lock 200 is illustrated in FIG. 15. During this operation, the upper bolt 235 has not changed position.

When the electromagnet 210 has received a return pulse, if the handles 207 are released they return to their intermediate position of rest and the connecting arm 212 resumes its retracted position. The door 204 is then in the position locked by the bolt 228, and any actuation of the handles 207 only allows the upper bolt 235 to be operated.

When a pulse is transmitted to the electromagnet 210 once again, the connecting arm 212 once more assumes its position in which its end 220 is in the notch 219 of the annular ring 218. When the handles 207 are moved down, the free end 220 of the connecting arm 212 engages with the other end of the notch 219 and drives this ring 218 in the opposite direction to the preceding direction. At the same time, the finger 226 carried by the ring 224 acts on the sheet 230 and the locking sheet 232 in the opposite direction to the preceding direction, and the finger 229 also carried by the ring 224 ensures that the bolt 228 is moved from its extended position to its retracted position. At the same time, the finger 237 carried by the plate 208 connected to the spindle 206 shifts the bolt 235 into its retracted position. The lock 200 resumes the state illustrated in FIG. 16, in which the bolts 228 and 235 are both in their retracted position.

If the handles 207 are released, when the electromagnet 210 has received a return pulse the connecting arm 212 returns to its retracted position, the handles 207 return to their intermediate position of rest and the bolt 235 returns to its extended position. The lock 200 is then once again in the state illustrated in FIG. 14.

It may be noted that, in the example illustrated in FIGS. 14 to 17, contrary to the preceding examples, the connecting arm 212 is carried by the component formed by the plate 208 which is connected to the handles 207, whilst the component formed by the ring 218, in which there is the recess 219 with which the connecting arm 212 interacts, is connected to the bolt 228 and a locking system consisting of the sheet 232 and the fingers 234 ensures that the bolt 228 is maintained in its extended position and its retracted position and is stressed by means of the connecting arm 212.

Furthermore, the lock 200 is completed by a system for the direct operation of the bolt 228, which comprises an operating knob 239 which extends outside the door 204 and of which the spindle 240 passing through the body part 202 carries a toothed quadrant 241 engaged with a toothed quadrant 242 located on the intermediate ring 224. Operating the knob 239 makes it possible to operate the bolt 228 by means of the fingers 226 and 229 as before, the rotation of the intermediate ring 224 moreover acting only on the ring 218 which rotates freely.

I claim:

1. Lock (1;100;200) with electrically controlled setting by means of an electromagnet, characterized in that it comprises:

a first and a second coaxial component (27,28) which are mounted rotatably in a lock body and of which one is connected to at least one bolt or any other locking means (4) in order to move it and the other to a handle or any other actuating means (30);

at least one electromagnet comprising a magnet (49) and a coil (46) coupled magnetically, at least one of the elements of this electromagnet being rotatably mounted coaxially relative to the said components, in order to be driven in rotation from a first angular end position to a second angular end position when the coil receives an electrical pulse;

at least one connecting element (55) mounted on the said first component and designed to be shifted between a first and a second end position, this connecting element (55), in its second position, being engaged with the second component, in order to connect the said first and second components in terms of rotation at least in one direction, whilst, in its first position, the said components are free to rotate relative to one another;

at least one cam (65) and one cam follower (66), of which one is carried by the movable element (44,46) of the said electromagnet and the other by the said connecting element (55), this cam (65) and this cam follower (66) being designed to interact so as to shift the said connecting element (55) in one direction from one of its end positions to the other, when the movable element (44, 46) of the electromagnet changes from its first angular position to its second angular position, and at least one restoring means designed to stress the said connecting element in its other shifting direction;

in such a way that, with the said components being in corresponding angular positions and being connected in terms of rotation by means of the said connecting element, the movement of the bolt connected to one of the said components is obtained as a result of the actuation of the other component which is connected to the handle.

2. Lock according to claim 1, characterized in that the said magnet (49) is stationary and the said coil (46) is pivotably mounted coaxially relative to the said components (27,28).

3. Lock according to claim 1, characterized in that the said magnet (49) and the said coil (46) are in the form of ring segments.

4. Lock according to any claim 1, characterized in that the said cam (65) and the said cam follower (66) are designed to interact so as to shift the said connecting element (55) from its first position to its second position, the said restoring means being a spring (60).

5. Lock according to any claim 1, characterized in that the said connecting element is formed by an arm (55) articulated on the said first component (28) eccentrically and radially movably, in such a way that its free end (63) can be brought into engagement with the said second component (27), the said cam (65) and the said cam follower (66) being designed to stress the said arm (55) radially.

6. Lock according to any claim 1, characterized in that elastic means stress at least one of the said components (27,28) towards a position of rest, in which the said connecting element (55) can be brought into engagement with the other component when the latter is in at least one corresponding position of rest.

7. Lock according to any claim 1, characterized in that the said lock body comprises a radial plate (43), from which an axial sleeve (42) projects, this radial plate (43) carrying the stationary element (49) of the electromagnet laterally on the same side as the said sleeve, a support (44), mounted rotatably on the said sleeve (42), carryin the movable element (46) of the electromagnet, the said first component comprising a radial plate (52) mounted rotatably in the said lock body and carrying an arm (55) articulated eccentrically and radially movably, the said second component (27) comprising an annular part (32) provided with at least one recess (64), the said rotary support (44) and the said arm (55) possessing one the said cam (65) and the other the said cam follower (66), the free end of the said arm (55) being designed to engage with at least one of the ends of the said recess (64) of the annular part (32) of the said second component (27).

8. Lock according to claim 7, characterized in that it comprises a lock body which has a part (14) coaxial relative to the said components and in which the said stationary radial plate (43) is located and the said cylindrical part (32) of the said second component (27) is mounted rotatably, the said first component comprising a shaft (28) extending through the said sleeve (42) and carrying the said plate (52) equipped with the said connecting arm (55), the said annular part (32) of the said second component (27) and the said shaft being connected one to an actuating handle (30) and the other to a bolt (7).

9. Lock according to any claim 1, characterized in that one of the said components (120; 208) is connected to an actuating handle (118;207), of which the spindle (116;206) is eccentric relative to the axis of the said coaxial components, the other component (108;218) being connected to a bolt (112;228).

10. Lock according to any one of the preceding claims, characterized in that it possesses such means (137,131; 232,234) of locking the bolt (112;228) that, with the said components being in corresponding angular positions and the said connecting element being in its second position, the latter, in a first phase of the rotary movement of the said first component, transmits a movement to intermediate means which act on the said locking means in the direction which releases the bolt and, in a second phase, causes the bolt to move.

* * * * *